United States Patent [19]

Kobelt

[11] 4,399,734

[45] Aug. 23, 1983

[54] POWER ASSIST DEVICE FOR CONTROL SYSTEM

[76] Inventor: Jacob Kobelt, 6110 Oak St., Vancouver, British Columbia, Canada, V6M 2W2

[21] Appl. No.: 173,350

[22] Filed: Jul. 29, 1980

[51] Int. Cl.[3] ..... F01B 31/12

[52] U.S. Cl. ..... 91/1; 91/216 R; 91/216 A

[58] Field of Search ..... 91/216 R, 216 A, 337, 91/378, 1; 74/876

[56] References Cited

U.S. PATENT DOCUMENTS

| | | | |
|---|---|---|---|
| 2,016,727 | 10/1935 | Roth | 91/1 |
| 2,073,921 | 3/1937 | Caracristi | 91/1 |
| 2,617,257 | 11/1952 | Douglas | 251/297 |
| 2,649,841 | 8/1953 | Jacques | 91/1 |
| 2,718,877 | 9/1955 | Rishel et al. | 91/216 A |
| 3,202,011 | 8/1965 | Kobelt | 74/876 |
| 3,216,454 | 11/1965 | Richter et al. | 91/216 R |
| 3,290,996 | 12/1966 | Floyd | 91/1 |
| 3,487,750 | 1/1970 | Borgeson | 91/216 R |

FOREIGN PATENT DOCUMENTS

| | | | |
|---|---|---|---|
| 362323 | 7/1962 | Switzerland | 91/216 R |
| 1246712 | 9/1971 | United Kingdom | 91/1 |

*Primary Examiner*—Martin P. Schwadron
*Assistant Examiner*—Richard L. Klein
*Attorney, Agent, or Firm*—Carver & Co.

[57] ABSTRACT

A power assist device for a control system to amplify force to assist in movement of control apparatus. Device has signal input device and directional valve which are both responsive to a control signal, and a fluid power cylinder assembly which is connectable to an input of the control apparatus to apply an amplified control signal thereto. The directional valve means controls fluid flow between first and second chambers on opposite sides of a piston of the power cylinder assembly so as to determine the direction of movement of the assembly in response to valve position. The signal input device has an indicator to indicate a particular control setting or datum for a control signal which can be felt by operator, which contrasts with prior art power assist device where feel of a particular setting location is lost.

8 Claims, 6 Drawing Figures

POWER ASSIST DEVICE FOR CONTROL SYSTEM

BACKGROUND OF THE INVENTION

1. Field of the Invention

The invention relates to a power assist devide for amplifying force from a control signal, particularly as used in marine control systems.

2. Prior Art

In a marine control system for throttle and clutch controls of a vessel it is usual to have several control heads located in various parts of the vessel, for example on the bridge, at the stern and in the engine room. These controls are integrated into a common control signal receiver which then transmits the control signal to the engine, clutch, etc. The various control heads interconnect with the control signal receiver by push-pull cables, tensioned cables, etc. and, in the larger vessels, a considerable length of cable is used, the cable often being subjected to bends to negotiate obstructions. Friction losses in the cable increase with the length of cable and the number of bends, and in some applications considerable force is required at the control head to overcome friction in the cable system to actuate the controls. Excessive friction contributes to loss of sensitivity or "feel" of the controls and it can be difficult to locate a desired setting or datum at the apparatus being controlled, for example it can be difficult to locate the neutral position on a gear box, or a selected throttle position.

In the past, power assist devices have been coupled to control systems to reduce the effects of friction at the control head, and, whilst applied force necessary to operate the controls has been reduced by these devices, loss of "feel" or sensitivity of the controls has resulted, further compounding the difficulty of locating a desired setting, for example neutral. Various devices have been developed to provide feel in power assist control systems, but to the applicant's knowledge, these devices have not provided positive feel for selected positions in such control systems.

A related device is shown in U.S. Pat. No. 3,202,011 issued in 1965 to the present inventor. When compared to the present invention, this patented device has several limitations, one of which is that it is adapted only for clutch control, and not combined clutch and throttle control as in the present invention.

SUMMARY OF THE INVENTION

The invention reduces difficulties and disadvantages of the prior art by providing a power assist device which is interposed between the various control heads of a vessel and the control signal receiver to provide an amplified control signal to the control signal receiver, thus alleviating the effects of friction in the connections between the control signal receiver and the various control heads. The device is compact, simple and can be fitted in many existing installations without requiring major redesign. Furthermore, the device has a structure provided with an indicating means or indexing means which permits an operator to "feel" a particular setting or datum when this is attained by the power assist device, which setting is reflected accurately by the control signal receiver or equivalent control apparatus.

The power assist device according to the invention is adapted to amplify force of a control signal to actuate an apparatus. The power assist device includes a directional valve means having a valve body with a valve bore, and a valve spool movable within the bore along a valve axis in response to the control signal. The valve body has a fluid inlet means to receive pressurized fluid and a fluid outlet means to discharge fluid. The valve body also has first and second fluid conduits which can communicate through the valve bore with either the fluid inlet means or fluid outlet means as determined by relative position of the valve spool so as to transmit fluid relative to the valve body. The device also includes a fluid power cylinder assembly having a cylinder body, a piston and a piston rod, the piston rod and piston being fixed so that the cylinder body is reciprocable relative to the piston. The cylinder body is connected to the valve body for mutual movement, and also cooperates with the apparatus to apply an amplified control signal thereto. The piston defines in part first and second chambers on opposite sides thereof, the first and second chambers communicating with the first and second fluid conduits of the directional valve means. The power assist device is further characterized by a guide rod and a fixed guide holder. The guide rod has a longitudinal guide axis disposed parallel to the valve axis, the rod being connected essentially rigidly to the valve spool for equal concurrent movement therewith along the guide axis in response to the control signal. The rod also has guide indexing means representing particular control settings. The guide holder cooperates with the guide rod to permit the guide rod to move axially relative to the guide holder, the guide holder having a holder indexing means complementary to the guide indexing means to serve as a datum and to register with the guide indexing means at a particular control setting. Thus, when the valve spool is shifted to direct fluid into one chamber and discharge fluid from the opposite chamber, the indexing means are disengaged and engaged as required to indicate attainment of a particular control setting. Also, the cylinder body shifts to actuate the apparatus in response to the control signal.

A detailed disclosure following, related to drawings, describes a preferred embodiment of the invention which is capable of expression in structure other than that particularly described and illustrated.

DETAILED DISCLOSURE

Figure 1:
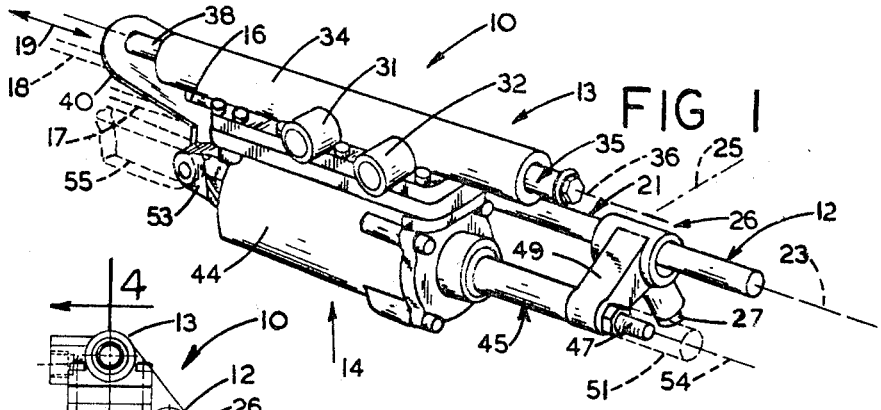
FIG. 1 is a perspective of the power assist device according to the invention shown cooperating with adjacent connections, a valve of the device being shown in a closed central position.
Figure 3:
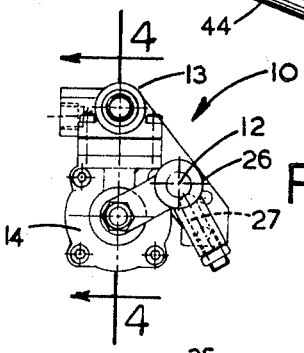
FIG. 3 is a simplified end elevation of the apparatus.
Figure 2:
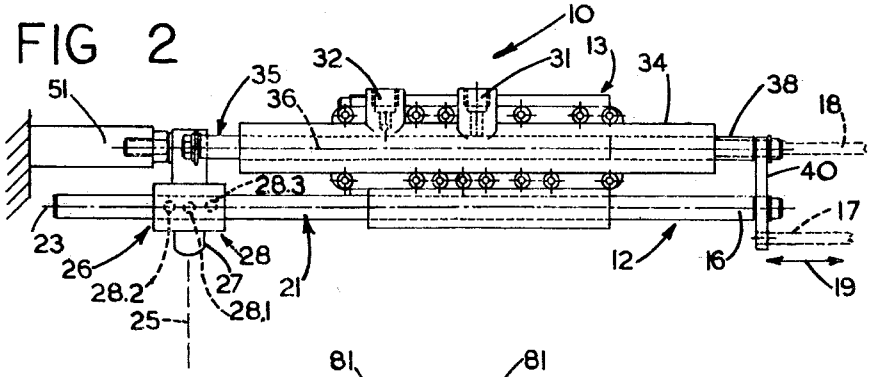
FIG. 2 is a simplified top plan of the apparatus, also showing adjacent connections.

FIGS. 1 through 3

A power assist device 10 according to the invention includes a signal input means 12, a directional valve means 13 and a fluid power cylinder assembly 14. The signal input means 12 has a first end portion 16 indirectly connected to an end of a cable 17, the cable extending to a control head, not shown, controlled by an operator to control an apparatus, not shown, for example an engine/gear box assembly for a marine control apparatus. The cable 17 is a core of a push/pull cable arrangement and is subject to axial motion according to a double headed arrow 19 in response to control signals. Alternatively the cable 17 could be a push rod or other signal responsive means cooperating with a control head to reflect signals from the operator. An additional cable 18 from an additional control head is similarly coupled to the means 12.

The signal input means 12 has a guide rod 21 having a longitudinal axis 23 and is adapted to serve as an elongated guide means to translate axial motion of the end of the cable 17 to the device 10. A guide rod bracket 26 is fixed relative to a datum 25 which is shown as a broken line, the bracket being secured to a fixed portion of the vessel. The guide rod bracket 26 has a bore to accept the guide rod 21 therein, and has sufficient length to ensure essentially parallel motion of the rod, thus serving as a guide holder to cooperate with the guide means to permit the guide means to move relative to the guide holder. The bracket 26 has a spring-loaded detent 27 adapted to engage one of several complementary recesses 28 in the rod. Three recesses 28.1, 28.2 and 28.3 are shown representing neutral, forward and reverse positions respectively for controls of a marine engine and gear box/clutch unit as commonly used on commercial fishing vessels. Clearly, other positions can be provided, and typically a control apparatus would have a range of movement between first and second positions, which in this case, is between full ahead and full astern. The guide rod 21 is thus responsive to the control signals and has a range of movement between similar first and second positions relative to the datum. The datum in this instance is selected as the detent 27 of the bracket 26, although another datum can be selected for a different installation.

In effect, the guide rod and guide holder provide a signal indexing means to represent a datum and various control settings representing control signals. Thus the bracket has a holder indexing means, namely the spring-loaded detent, which is adapted to cooperate with the guide indexing means, namely the recesses in the rod, to register the rod so that the datum means of the rod can be located relative to the datum of the signal receiving means, and other control settings can similarly be located on the guide rod reflecting control settings selected by the control head.

The directional valve means 13 has a fluid inlet conduit 31 to receive pressurized fluid from a source, not shown, and a fluid outlet conduit 32 to discharge fluid to a sump, not shown. The directional valve means has a valve body 34, an axial valve spool 35 and a longitudinal axis 36, the spool being adapted for movement along the axis 36. The valve spool has a first end portion 38 extending from the valve in the same direction as the first end portion 16 of the means 12. A connecting means 40 extends betwen the first end portions 16 and 38 and connects them rigidly together to ensure parallel equal movement between the input means 12 and the valve spool 35, and also interconnects ends of the cables 17 and 18 to the signal input means.

It can be seen that the longitudinal axis 36 of the valve means is disposed parallel to the longitudinal axis 23 of the signal input means 12 and that movement of one exactly equals movement of the other. Furthermore, relative axial position of the guide rod 21 as determined by one of the particular recesses 28 locates the spool 35 of the valve means 13 similarly relative to the datum 25. Thus, the guide rod 21 provides a direct control for the valve spool to position the valve spool axially at a particular position relative to the datum. The guide rod therefore reflects accurately position of the spool which itself determines operation of the power assist device.

The fluid power cylinder assembly 14 has a cylinder body 44 and a piston rod 45 extending therefrom, the rod having an outer end 47 connected to an arm 49 carrying the guide rod bracket 26. The end 47 is threaded and mounted on a securing bracket 51 secured to a portion of the vessel. This fixes the piston rod and the rod bracket, and thus the bracket 51 simultaneously locates the piston rod and the guide rod bracket to provide effectively a datum for both the power cylinder assembly and the signal input means. The cylinder body 44 has an axial extension 53 extending from an end remote from the piston rod, the extension being connected to an input rod 55 of an apparatus to receive the amplified signal control, for example a signal receiver of the control apparatus which integrates clutch and throttle signals of single lever controls.

Thus, it can be seen that the fluid power cylinder has the outer end of the piston rod located relative to a datum which also locates the guide rod bracket, and an opposite end of the cylinder body is connected to the apparatus to be controlled. It can be seen that a control signal from the control head is received simultaneously by the signal input means 12 and the directional valve means 13. The guide rod then moves relative to the guide rod bracket an amount dependent on the signal, and the spool of the directional valve means also moves simultaneously a similar amount. As the valve shifts, fluid is directed to, and returned from the fluid cylinder assembly as determined by the signal, the cylinder assembly simultaneously shifting to apply an amplified force to the apparatus to be controlled. Thus the fluid power cylinder assembly 14 has a longitudinal axis 54 disposed parallel to the longitudinal axis 23 of the valve means, and one portion of the assembly 14 is fixed relative to the datum 25 of the signal input means. Internal details and operation of the directional valve means and fluid power cylinder assembly 14 are to be described with reference to FIGS. 4 through 6.

FIG. 4

The valve body 34 has a valve bore 61 to accept the valve spool 35 as a sliding fit therein. The valve spool has a second end portion 62 remote from the first end portion 38 and also has a first and second lands 63 and 64 spaced apart on the spool to provide an inner clearance 66 therebetween, the lands being spaced apart at a land spacing 69. First and second outer clearances 67 and 68 are disposed adjacent outer portions of the first and second lands respectively. The end portions 38 and 62 each have cup seals 70 adjacent the first and second outer clearances to essentially prevent leakage of fluid from the valve bore.

Figure 4:
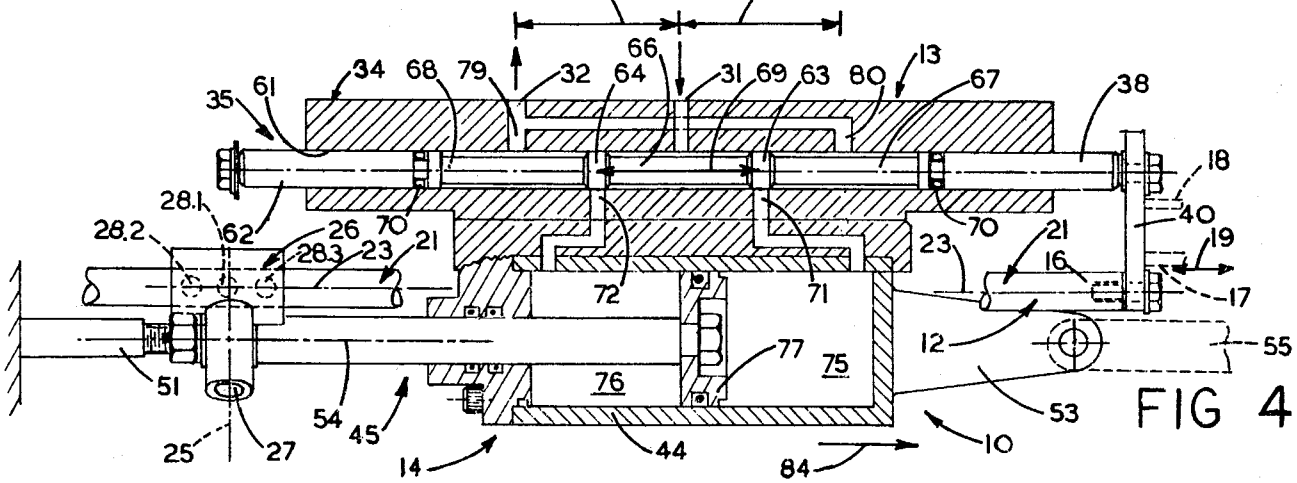
FIG. 4 is a simplified, partially diagrammatic, fragmented section of the apparatus, taken generally on Line 4—4 of FIG. 3, but also showing portions of adjacent structure, the valve being shown in a closed central position.

The valve body 34 has first and second fluid conduits 71 and 72 which enter the valve bore 61 at a spacing equal to the land spacing 69 so that both conduits can be closed by the first and second lands 63 and 64, as shown in FIG. 4. The assembly 14 has a piston 77 within the body 44 connected to an inner end of the piston rod 45, the piston dividing the cylinder into first and second chambers 75 and 76. The piston 77 and piston rod 45 are sealed within the cylinder body to essentially prevent leakage, and the cylinder is reciprocable relative to the piston to define in part the variable first and second chambers on opposite sides of the piston. The first and second fluid conduits 71 and 72 extend from the valve bore 61 to the first and second chamber 75 and 76 respectively. In the spool position as shown, it can be seen that the piston 77 is hydraulically locked within the cylinder body 44 by the lands 63 and 64, and is termed a stabilized position.

The fluid inlet conduit 31 enters the valve bore 61 at a position midway between the first and second fluid conduits 71 and 72. The fluid outlet conduit 32 is bifurcated and has outlet conduit portions 79 and 80 which enter the valve bore 61 at positions on opposite sides of the conduit 31 and spaced therefrom at outlet portion spacings 81 which are approximately equal to the land spacing 69. The actual routing or location of the conduits 31 and 32 and outlet portions 79 and 80, and also the first and second conduits 71 and 72 are not exactly as shown in FIG. 4, which is partially diagrammatic. Clearly, the conduit routing is dependent on manufacturing preferences and other factors, for example see the lateral location of the conduits 31 and 32 in FIG. 1. Relative spacing between the lands 63 and 64, and the locations of the openings of the conduit 31 and the conduit portions 79 and 80 within the valve bore 61 determines the acceptable range of movement of the valve spool relative to the valve body. Suitable stops, not shown, prevent excessive movement so as to prevent a possible hydraulic lock which otherwise could occur if the lands 63 or 64, or the end portions 38 or 62 block the inlet or outlet conduits. Because the openings of the various conduits in the valve bore are relatively widely spaced, it can be seen that the spool 35 can tolerate a relatively large, fast movement, eg. from full ahead to full astern, depending on the control signal stroke. This is particularly important when the present device is used with a control signal splitter coupled to single lever control heads, as in the present inventor's copending United States application. With such devices a relatively long stroke linear input rod is used, the rod having indexes indicating neutral and idle "ahead" and idle "astern," with considerable linear movement to full ahead and full astern straddling the idle positions. The relatively wide spacing between lands of the invention permits use of such this invention where long travel is required.

OPERATION

Figure 5:
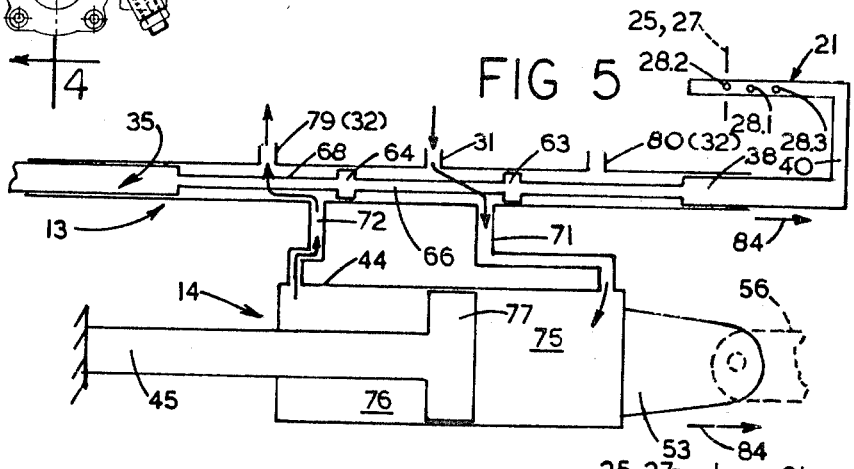
FIG. 5 is a simplified schematic of a transient condition which is generally similar to FIG. 4, but with the valve shown displaced in a forward direction and also showing cooperation with a signal indexing means.
Figure 6:
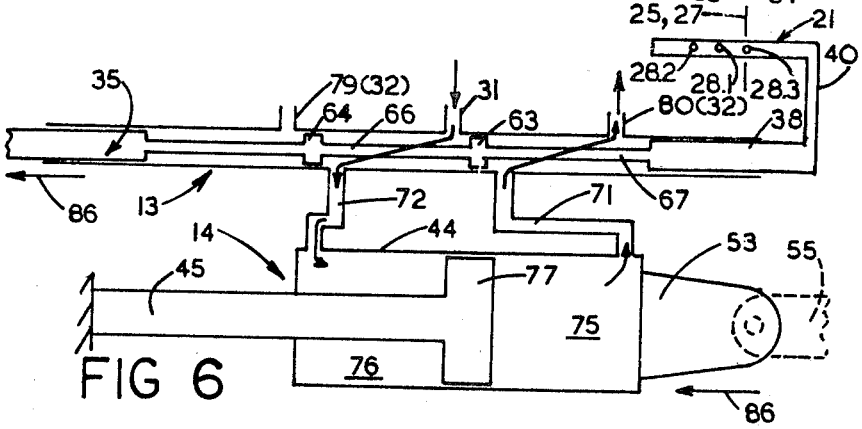
FIG. 6 is a simplified schematic of another transient condition, generally similar to FIG. 5, but with the valve displaced in an opposite direction.

FIGS. 4 through 6

Referring again to FIG. 4, the valve spool 35 is shown in the central stabilized position in which the lands 63 and 64 close the first and second conduits 71 and 72, and thus hydraulically lock the piston relative to the cylinder body 44 and prevent fluid flowing to or from the conduits 31 and 32. For convenience, FIG. 4 is shown with the detent 27 at the datum 25 engaging the recess 28.1, which is selected as a neutral setting, straddled by forward and reverse positions or setting designated as the recesses 28.2 and 28.3.

In FIG. 5, the guide rod 21 and the valve spool are shown displaced a small distance in the forward direction per arrow 84 which represents a transient condition immediately after a change in control signal. The detent 27 now engages the recess 28.2 and the lands 63 and 64 have shifted to uncover the conduits 71 and 72 respectively. This permits fluid entering the inlet conduit 31 to pass through the inner clearance 66 into the first conduit 71 and thence into the first chamber 75. Because the piston rod 45 is fixed relative to the datum 25, flow of fluid into the first chamber 75 expands the chamber 75 which causes movement of the cylinder body 44 also in direction of the arrow 84. This movement reduces volume of the chamber 76, discharging fluid therefrom through the conduit 72, through the outer clearance 68 so as to discharge through the conduit portion 79 and outlet conduit 32. Because the cylinder body 44 is secured to the valve body 34, the valve body shifts concurrently with the cylinder body, thus moving the conduits towards the lands 63 and 64 at a speed determined by the volume of fluid flow into and out from the first and second chambers. As the locations of openings of the conduits 72 and 71 approach the lands 63 and 64, flow of fluid through the conduits 71 and 72 is progressively reduced until it is stopped, at which time the lands 63 and 64 again completely close the conduits 71 and 72 returning the assembly to a hydraulically locked stabilized position. Movement of the cylinder body 44 in direction of the arrow 84 is transferred through the axial extension 53 to the input rod 55. Force available from the cylinder is proportional to pressure of fluid within the cylinder and the bore of the cylinder, and can be many times greater than force applied to the valve spool 35 and the guide rod 21. The recess 28.2 is still engaged by the detent 27 and thus movement of the input rod is exactly equal to space between the recess 28.1 and 28.2, thus reflecting the control signal precisely. In effect the detents are felt by the operator who then can ascertain, from his control head position, which recess the detent has engaged. It should be understood that the control head used by the operator to select particular control settings is only a fairly approximate indication of the setting, and that the actual "feeling" of the detent engaging a particular recess is a much more positive indication of the setting. Thus a better feel of the control setting is attained and it can be seen that the recesses and detent serve as signal indexing means of the signal input means to indicate attainment of the particular control setting.

Referring to FIG. 6, movement of the rod 21 and the spool 35 from the FIG. 4 location in an opposite direction, that is the reverse direction per arrow 86, causes the detent 27 to engage the recess 28.3 and moves the lands 63 and 64 in an opposite direction. This opposite direction exposes the second conduit 72 to fluid from the inlet conduit 31 which passes the inner clearance 66 and enters the second chamber 76, thus causing displacement of the cylinder body in direction of the arrow 86. Similarly, fluid from the first cylinder 75 is displaced into the first conduit 71, leaving the valve body through the outlet conduit portion 80 and the conduit 32.

Thus, in summary, the directional valve means is responsive to the control signal and has first and second fluid conduits which communicate with either the inlet or outlet fluid conduits to transmit fluid as determined by the valve position. Thus fluid is conducted into one chamber and discharged from the opposite chamber of the hydraulic power cylinder assembly. It can be seen that the fluid power cylinder assembly 14 is connected to an input of the control apparatus to apply an amplified control signal to the control apparatus in the same direction as movement of the valve spool, thus reducing effects of friction in the cable system. The valve member, eg. the spool 35, and valve body can be seen to cooperate with each other so that relative axial movement between the body and valve member changes flow through the valve, so as to selectively direct fluid to, and receive fluid from, opposite sides of the piston.

Clearly, because movement of the valve spool is paralleled by movement of the guide rod, it follows that when the detent 27 locates any of the recesses 28.1, 28.2 or 28.3, the axial extension 53 will be displaced a similar amount. This ensures an accurate reflection of displacement of the guide rod from the datum of the original signal, which ensures the desired location of the input rod 55 of the signal receiver. The fluid power cylinder assembly thus accurately follows movement of the guide rod as a slave unit, thus reflecting the control signal and ensuring accurate selection of gears, engagement of clutch, etc. The invention provides a simple hydraulic servo mechanism in which accurate location of a slave unit is ensured by a simple guide rod which can be indexed where required, the indexes being "felt" by an operator at a remote control head. Thus, notwithstanding friction losses in a control set up, power assist controls can be used in which particular settings of a control apparatus can be felt by an operator. Thus the indexes on the signal input means, namely the input rod, serve as indicator means to indicate to an operator a control setting.

ALTERNATIVES AND EQUIVALENTS

The device 10 as shown has, as a signal input means, a guide means being an elongated straight guide rod having a longitudinal axis and being adapted for movement along the axis in response to the control signal. Other signal input means can be substituted, but it is preferrable that the signal input means has indexing means thereon to ensure positive location of the rod, so that the first datum means of the rod can be located accurately relative to the datum of the signal receiving means, and that this location can be felt by an operator.

Also, other types of directional valves can be substituted for that shown, with alternative land and conduit structures. Wide spacing between conduit openings in the valve bore is preferred to increase tolerance to rapid changes in signals. Also, the relative functions of the piston and cylinder of the fluid power cylinder can be reversed.

I claim:

1. A power assist device adapted to amplify force of a control signal to actuate an apparatus, the power assist device including a directional valve means having a valve body with a valve bore, and a valve spool movable within the bore along a valve axis in response to the control signal, the valve body having a fluid inlet means to receive pressurized fluid and a fluid outlet means to discharge fluid, the valve body also having first and second fluid conduits which can communicate through the valve bore with either the fluid inlet means or fluid outlet means as determined by relative position of the valve spool so as to transmit fluid relative to the valve body, the device also including a fluid power cylinder assembly having a cylinder body, a piston and a piston rod, the piston rod and piston being fixed so that the cylinder body is reciprocable relative to the piston, the cylinder body being connected to the valve body for mutual movement, and also cooperating with the apparatus to apply an amplified control signal thereto, the piston defining in part first and second chambers on opposite sides thereof, the first and second chambers communicating with the first and second fluid conduits of the directional valve means, the power assist device being further characterized by:

(a) a guide rod having a longitudinal guide axis disposed parallel to the valve axis, the rod being connected essentially rigidly to the valve spool for equal concurrent movement therewith along the guide axis in response to the control signal, the rod also having guide indexing means representing particular control settings, (b) a fixed guide holder cooperating with the guide rod to permit the guide rod to move axially relative to the guide holder, the guide holder having a holder indexing means complementary to the guide indexing means to serve as a datum and to register with the guide indexing means at a particular control setting, so that when the valve spool is shifted to direct fluid into one chamber and discharge fluid from the opposite chamber, the indexing means are disengaged and engaged as required to indicate attainment of a particular control setting, and the cylinder body shifts to actuate the apparatus in response to the control signal.

2. A power assist device as claimed in claim 1 in which:

(a) the guide rod has a first end portion, (b) the spool valve has a first end portion extending from the valve body in the same direction as the first end portion of the guide rod, (c) connecting means extend between the first end portions of the valve spool and the guide rod to ensure concurrent equal and parallel movement between the guide means and the valve spool.

3. A power assist device as claimed in claim 1 or 2 in which:

(a) the piston rod is connected to the guide holder to establish the datum for the device.

4. A power assist device as claimed in claim 1 or 2 in which:

(a) the piston rod has an outer end connected to the guide holder, the outer end being adapted to be fixed as required to establish the datum for the device.

5. A power assist device as claimed in claim 1 or 2 further characterized by:

(a) the guide holder being a guide rod bracket having a bore to receive the guide rod therein and sufficient length to ensure essentially parallel motion of the rod.

6. A power assist device as claimed in claim 1 or 2 further characterized by:

(a) the valve spool having clearances and at least one land thereon adapted to cooperate with the fluid conduits to control fluid flow through the valve means as required.

7. A power assist device as claimed in claim 6 further characterized by:

(a) the valve spool has first and second lands thereon spaced apart at a land spacing to define an inner clearance therebetween and first and second clearances adjacent outer sides of the first and second lands, (b) the first and second fluid conduits enter the bore at a spacing equal to the land spacing to permit closure of the first and second conduits by the lands so as to hydraulically lock the fluid power cylinder assembly.

8. A power assist device as claimed in claim 1 or 2 in which:

(a) the guide indexing means including at least one recess on the guide rod, (b) the holder indexing means being a spring loaded detent adapted to engage the recess in the guide rod.

* * * * *